US005416458A

United States Patent [19]

Menke et al.

[11] Patent Number: 5,416,458

[45] Date of Patent: May 16, 1995

[54] POWER DISTRIBUTION TRANSFORMER FOR NON-LINEAR LOADS

[75] Inventors: Wallace W. Menke, Lake Geneva, Wis.; Frank B. Croft; John J. Nay, both of Goldsboro, N.C.

[73] Assignee: General Signal Corporation, Stamford, Conn.

[21] Appl. No.: 691,209

[22] Filed: Apr. 25, 1991

[51] Int. Cl.[6] ..... H01F 33/00

[52] U.S. Cl. ..... 336/12

[58] Field of Search ..... 336/12, 222; 318/813, 318/798, 814, 815, 806; 323/206, 207, 208, 256; 363/71

[56] References Cited

U.S. PATENT DOCUMENTS 3,585,484 6/1971 Dortort ..... 321/5
3,839,667 10/1974 King ..... 321/9 R
4,386,394 5/1983 Kocher et al. ..... 363/20
4,723,104 2/1988 Rohatyn ..... 318/813

*Primary Examiner*—Leo P. Picard
*Assistant Examiner*—Christopher Horgan
*Attorney, Agent, or Firm*—Ohlandt, Greeley & Ruggiero

[57] ABSTRACT

An electrical power distribution transformer of the delta/wye configuration wherein the wye secondary windings are connected in a zigzag configuration and distributed among the legs of a multi-legged transformer core to achieve substantial attenuation of flux produced by undesired triplen harmonic (third and its multiples) currents arising from non-linear loads. The transformer also achieves a substantial reduction in capacitive coupling between the primary and secondary winding by means of an electrostatic shield positioned between the primary and secondary windings and by means of a metallic ground plane positioned as a barrier between the primary and secondary terminals.

3 Claims, 4 Drawing Sheets

POWER DISTRIBUTION TRANSFORMER FOR NON-LINEAR LOADS

BACKGROUND OF THE INVENTION

This invention relates to electrical power distribution equipment and in particular to a new and improved electrical distribution transformer especially suited for non-linear load applications.

Non-linear loads are characterized by devices such as switching mode power supplies, electronic ballasts and the like which produce harmonic currents and voltages that affect the distribution transformer. These harmonics are especially rich in the third harmonic and its multiples (triplen). In standard three phase delta/wye (primary winding connected in the delta configuration and secondary winding in the wye configuration), the triplen currents flowing in the wye secondary winding are in phase and additive in the common or neutral line. As a result, the net effect is a rather large triplen current in the neutral line which by transformer action results in a large triplen current that circulates in the primary delta winding. This leads to overheating, equipment breakdown and in the extreme, to fire.

In addition to harmonics produced by a non-linear load, the distribution transformer is also subjected to harmonics on the source bus that feeds its primary winding. Source harmonics can be caused, for example, by other distribution transformers connected in the power distribution system and which are not designed for either elimination of, or substantial attenuation of harmonics produced by their respective loads.

In the past, several attempts have been proposed or made to address the non-linear load problem. One such attempt involves the use of larger transformers to handle the extra heat generated by the triplen currents. Unfortunately, the neutral third harmonic currents have been so high that unacceptable overheating still occurs due to the triplen flux resulting in failure.

Another prior attempt uses filters which are tuned to the third, fifth, seventh and/or ninth harmonics, for example, and are located in the load circuit to block or trap the load produced harmonics. However, the loads are dynamic in operation such that the system resonance value is continually varying. This degrades or even eliminates the effectiveness of the filters.

Still another attempt is the Dry-type Transformer for Non-linear (Non-sinusoidal) Loads of International Transformer Corporation, Montebello, Calif. This transformer employs a number of features. First, it uses an enlarged primary winding conductor to reduce the harmonic (triplen) circulating current heating effect within the primary delta winding. Second, the unit is designed with a lower magnetic flux density in the core so as to handle the additional flux produced by the harmonic currents without saturation of the core. Third, an electrostatic shield is positioned between the windings for attenuation of common mode, high frequency harmonics. Fourth, the secondary winding employs, where necessary, small multiple conductors in parallel to reduce the skin effect of the high frequency harmonics. Fifth, all conductors are insulated and transposed, when necessary, to reduce the stray loss heating effect of the harmonic currents within the windings of the transformer, keeping the temperature rise of the unit within its design limits. Sixth, the neutral terminal has twice the current carrying capacity of the phase currents. Despite all of these features, this transformer is still subject to additive triplen harmonic currents that circulate in its delta winding and non-triplen currents that produce voltage stress within the coils.

BRIEF SUMMARY OF THE INVENTION

An object of the present invention is to provide a novel and improved electrical distribution transformer suitable for use with non-linear loads.

Another object is to provide an electrical distribution transformer in which third harmonic current and/or voltage arising due to a non-linear load are substantially attenuated.

Still another object is to provide an electrical distribution transformer in which the triplen harmonic currents are not transformed into the source distribution grid.

Yet another object is to provide an electrical distribution transformer in which the voltage stresses produced by the non-triplen harmonic currents will not degrade the insulation system.

The invention is embodied in a three-phase electrical power distribution transformer adapted to translate a three-phase power supply voltage at a supply frequency to a non-linear load system which produces undesired harmonic currents, namely, triplen harmonic currents which cause undesirable heating and the non-triplen harmonic currents which cause voltage stresses within the transformer coils. The transformer has a winding assembly mounted on a magnetic core. The winding assembly has a plurality of primary windings connected in a delta configuration to receive the supply voltage and a plurality of secondary windings connected in a wye configuration with first, second and third phase leads and a neutral lead for inter connection with the non-linear load system. In accordance with the invention, the secondary windings are connected into a zigzag wye configuration such that flux in the transformer core produced by the undesired triplen harmonic currents is substantially attenuated resulting in a substantially attenuated triplen current (or even no triplen current for balanced non-linear loads) in the delta connected primary.

BRIEF DESCRIPTION OF THE DRAWINGS

In the drawings like reference characters denote like elements of structure and.

DESCRIPTION OF PREFERRED EMBODIMENT

A transformer embodying the invention may be any three phase, general type of construction, non-ventilated, ventilated, gas filled or liquid-immersed. The transformer may be furnished to supply the three phase voltage requirements of any end user from any three phase voltage supply grid or bus. The term distribution transformer used herein may refer to any of the above.

Figure 1:
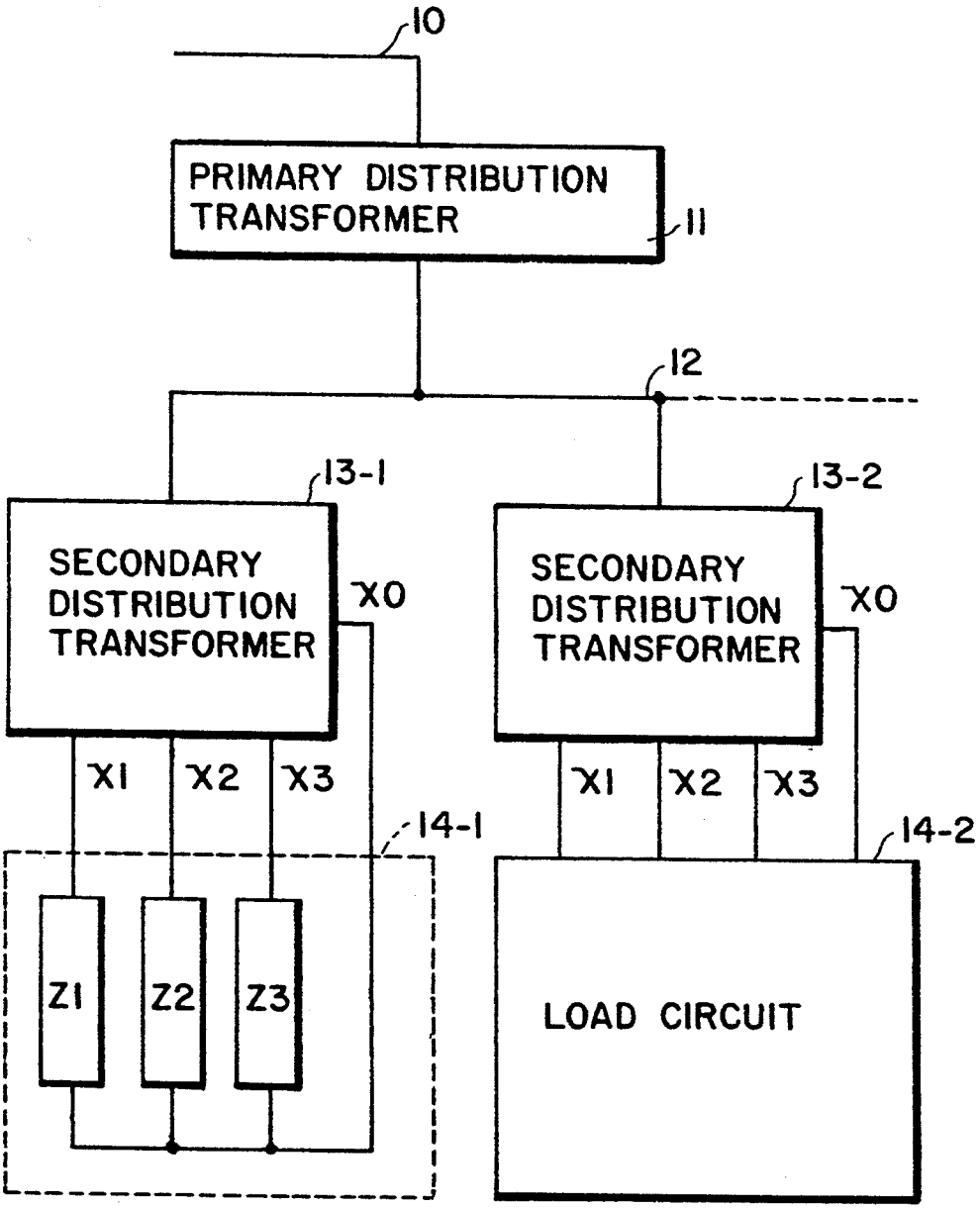
FIG.1 PRIOR ART
FIG. 1 is a block diagram of an exemplary and known power distribution system in which the distribution transformer of the present invention may be employed.

Illustrated in FIG. 1 is an exemplary electrical power distribution system in which power distribution transformers embodying the present invention may be employed. Electrical power is supplied by a public utility (not shown) via a cable 10 to a primary distribution transformer 11. The electrical power supplied on cable 10 is typically rated at 480 to 13,800 volts, three phase, and is translated by a primary distribution transformer 11 to a source bus 12 to a typical rating of 230 to 600 volts, three phase, for delivery to site locations which are equipped with secondary distribution transformers 13-1 and 13-2. The dashed connection for source bus 12 indicates that it may be interconnected with other secondary distribution transformers (not shown). The source bus 12, though illustrated as a single lead, is actually a bus which has a number of electrical wires, at least one for each of three phases of three-phase electrical power.

Each of the secondary distribution transformers 13-1 and 13-2 has secondary output phase leads X1, X2 and X3 and a neutral or common lead X0 which are interconnected with respective load circuits 14-1 and 14-2. The load circuits 14-1 and 14-2 are substantially similar in nature. Accordingly, only load circuit 14-1 is illustrated in any detail. Load circuit 14-1 is shown to have three loads Z1, Z2 and Z3 connected between the common lead X0 and the phase leads X1, X2 and X3, respectively.

Figure 2:
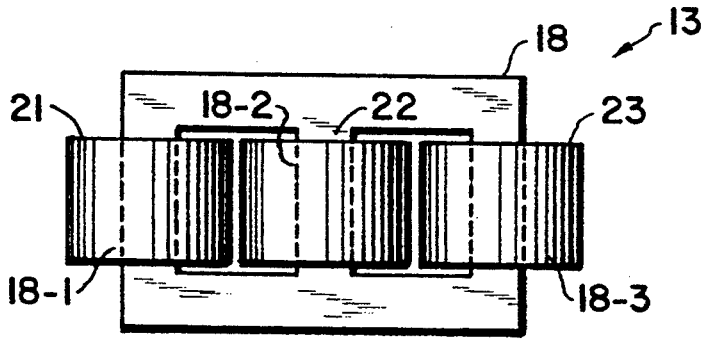
FIG.2 PRIOR ART
FIG. 2 is a partial schematic view of a power distribution transformer construction which has been employed in the prior art and which can be employed with the embodiments of the present invention.

A typical transformer construction for the secondary distribution transformers 13-1 or 13-2 is illustrated at 13 in FIG. 2. The transformer 13 has a magnetic steel core 18 with three core legs 18-1, 18-2 and 18-3. Mounted on core legs 18-1, 18-2 and 18-3 are winding assemblies 21, 22, and 23, respectively. Each winding assembly has a primary winding assembly and a secondary winding assembly (neither shown in FIG. 2) arranged concentrically with one another.

In the description which follows, primary windings will be identified by reference characters, of which the second digit will correspond to the second digit of the FIG. 2 winding assembly (and hence core leg) of which it is a part together with a suffix P. Similarly, secondary windings will also be identified by reference characters, the second digit of which corresponds to the second digit of the FIG. 2 winding assembly (and hence core leg) of which it is a part together with a suffix S. Thus, primary winding 31P and secondary winding 31S in FIG. 3 are contained in winding assembly 21 on core leg 18-1.

Figure 3:
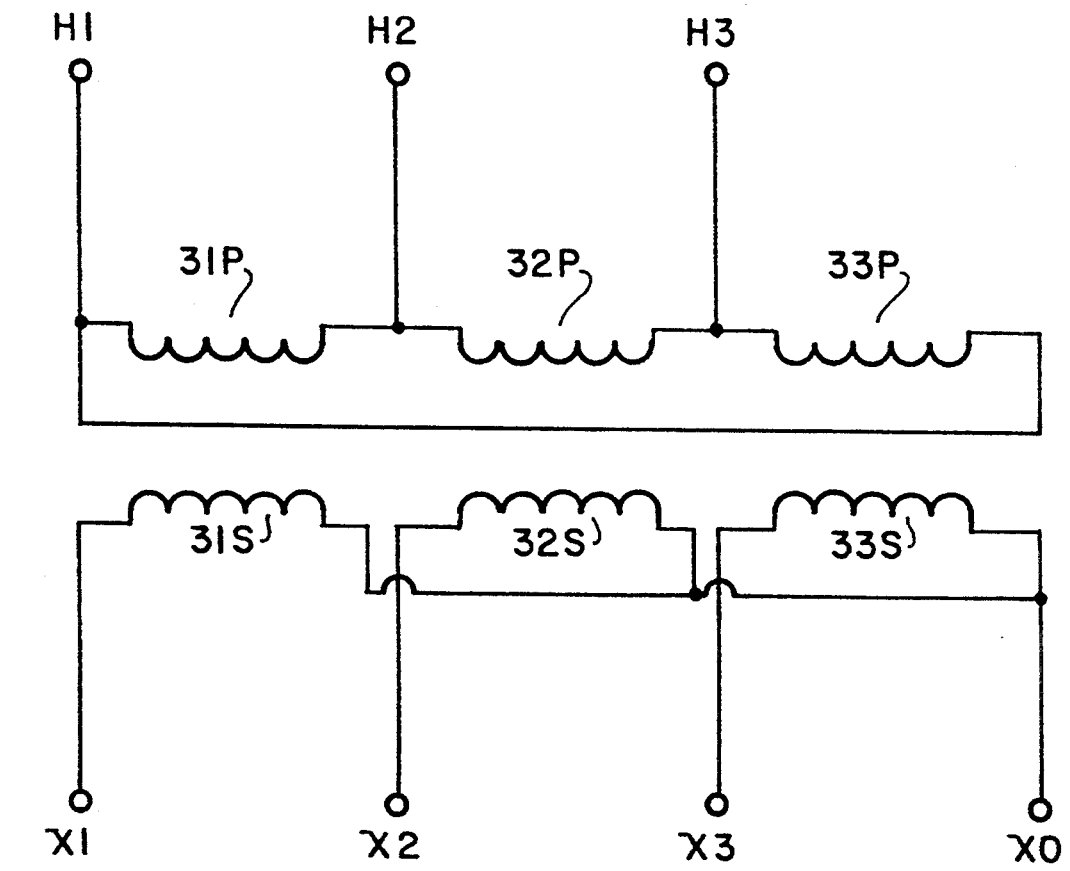
FIG.3 PRIOR ART
FIG. 3 is a circuit diagram, in part, of the prior art transformer windings and a phasor diagram, in part, illustrating the additive effect of triplen harmonic currents.
Figure 3:
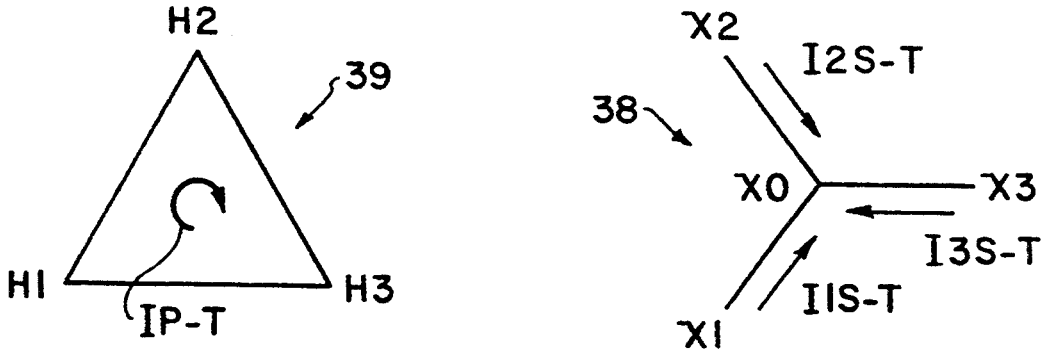
FIG.3 PRIOR ART

Referring now to FIG. 3, a typical prior art power distribution transformer winding connection is illustrated in which primary windings 31P, 32P, and 33P are connected in a delta configuration. To this end, these windings are connected in series with input lead H1 connected to the juncture of windings 31P and 33P, input lead H2 connected to the junctures of windings 31P and 32P an input lead H3 connected to the juncture of windings 32P and 33P.

The secondary windings of the typical prior art transformer of FIG. 3 are connected in a wye configuration. To this end, the right hand ends of the secondary windings 31S, 32S and 33S are connected in common to an X0 neutral lead. The left hand ends of the windings 31S, 32S and 33S are connected to secondary phase leads X1, X2 and X3, respectively.

The delta/wye power transformer illustrated in FIG. 3 has been satisfactory for applications in which the load system 14-1 or 14-2 of FIG. 1 is linear. However, load systems in the recent past have been characterized by increased use of devices such as switching mode power supplies, electronic ballasts and the like which produce harmonics of the supply voltage frequency. These harmonics are especially rich in triplen harmonics (the third and its multiples).

Load produced currents of the triplen harmonics are especially troublesome in that they are in phase in the three load circuits Z1, Z2 and Z3 and, hence, additive in the neutral lead. This is illustrated by the phasor diagram at 38 (FIG. 3) for the wye secondary in which the triplen phase vectors I1S-T, I2S-T and I3S-T are all in phase and additive in the neutral X0. If the secondary triplen phase currents are large, the transformer core can saturate. Triplen flux is in the same direction in all the three legs of the core. The only return path for this flux is through the air and/or an enclosure case when saturation occurs. By transformer action, this results in a large circulating triplen harmonic current in the delta connected primary windings 31P, 32P and 33P. This circulating current is illustrated by the clockwise arrow IP-T in the phasor diagram 39 in FIG. 3. The large circulating current in the delta primary leads to overheating, equipment breakdown, saturation of the magnetic core and, in extreme cases, to fire.

We have found that the undesired load produced harmonics, especially the triplen harmonic, are substantially attenuated by connecting the secondary winding in a zigzag wye configuration. This is illustrated in the FIG. 4 transformer embodiment of the present invention in which each secondary winding assembly has two separate coils distributed on two different legs of a multi-leg core. Thus, the secondary winding assembly (corresponding to winding assembly 21 in FIG. 2) has two coils 41S-1 and 41S-2. Similarly, winding assembly 22 has secondary coils 42S-1 and 42S-2 and winding assembly 23 has secondary coils 43S-1 and 43S-2.

To achieve an interconnection in the zigzag wye configuration, phase lead X1 is connected to the left hand end of secondary coil 41S-1, the right hand end of which is connected to the right hand end of secondary coil 43S-2 which has its left hand end connected to the neutral lead X0. Similarly, phase lead X2 is connected to the left hand end of secondary coil 42S-1 which has its right hand end connected to the left hand end of secondary coil 41S-2 which in turn has its left hand end connected to the neutral lead X0. Finally, phase lead X3 is connected to the left hand end of secondary coil 43S-1 which has its right hand end connected to the left hand end secondary coil 42S-2 which in turn has its left hand end connected to the neutral lead X0.

Due to (1) the in-phase nature of the triplen harmonic current in each phase circuit branch and (2) the zigzag connection, there is a substantial attenuation of the triplen harmonic currents between the primary and the secondary. The zigzag connection and winding distribution results in triplen harmonic flux in opposite directions in each leg of the core with a net effect of the cancellation of the magnetic flux under balanced load conditions.

Figure 5:
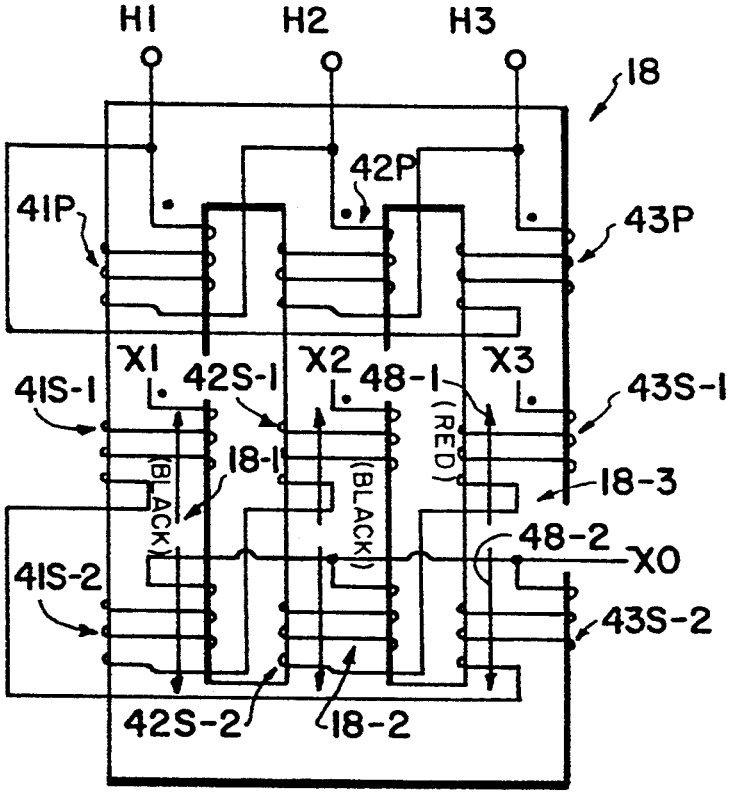
FIG. 5 is a partial circuit schematic diagram illustrating the arrangement of the zigzag winding on the magnetic core.
Figure 6:
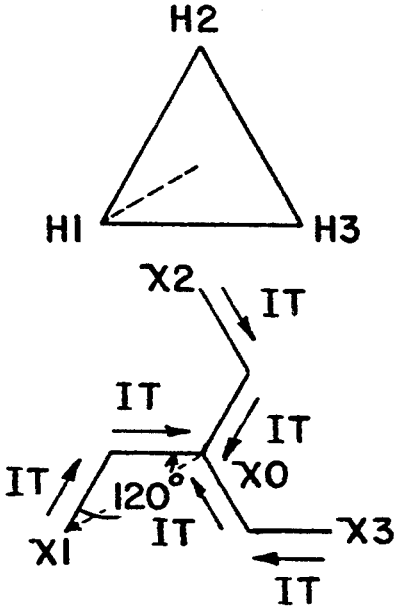
FIG. 6 is a phasor diagram for the zigzag wye connected secondary.

This is illustrated in FIGS. 5 and 6. FIG. 5 shows the primary and secondary windings arranged on the three core legs of the transformer core. Thus, the X1-X0 phase branch has winding 41S-1 on core leg 18-1 and winding 43S-2 on core leg 18-3. The top end of winding 41S-1 and the bottom windings of 43S-2 are labeled as A to illustrate a common connection which has been omitted from the drawing to avoid clutter. The X2-X0 phase branch has windings 42S-1 and 41S-2 on core legs 18-2 and 18-1, respectively. The X3-X0 phase branch has windings 43S-1 and 42S-2 on core legs 18-3 and 182, respectively.

The flux cancellation under balanced triplen harmonic conditions is illustrated by the oppositely directed flux vector arrows in the respective core legs. Thus, flux vectors 48-1 and 48-2 in core leg 18-3 are in opposite directions so as to result in a cancellation of the magnetic flux under balanced triplen harmonic conditions and therefore, no induced triplen harmonic current flowing in the delta primary.

Due to the relative locations of the two coils in each phase branch, i.e., each on a different core leg, there is a phase shift in the secondary power current (supply frequency) which results in a magnitude reduction. To compensate, the winding turns in each phase branch are increased by approximately 15% to 16%, over the secondary winding turns normally used in a conventional delta/wye (no zigzag connections) design. By way of example, a delta/wye transformer that is designed for 480 volts input to 480 volts output with one volt per turn would have 480 turns per primary coil and 277 turns per secondary coil. The same transformer with a zigzag secondary has one-half of a phase coil on each of two legs of the three phase core. Because of the 120° phase shift (60 Hertz supply frequency) each half of the coil would have 160 turns.

Figure 4:
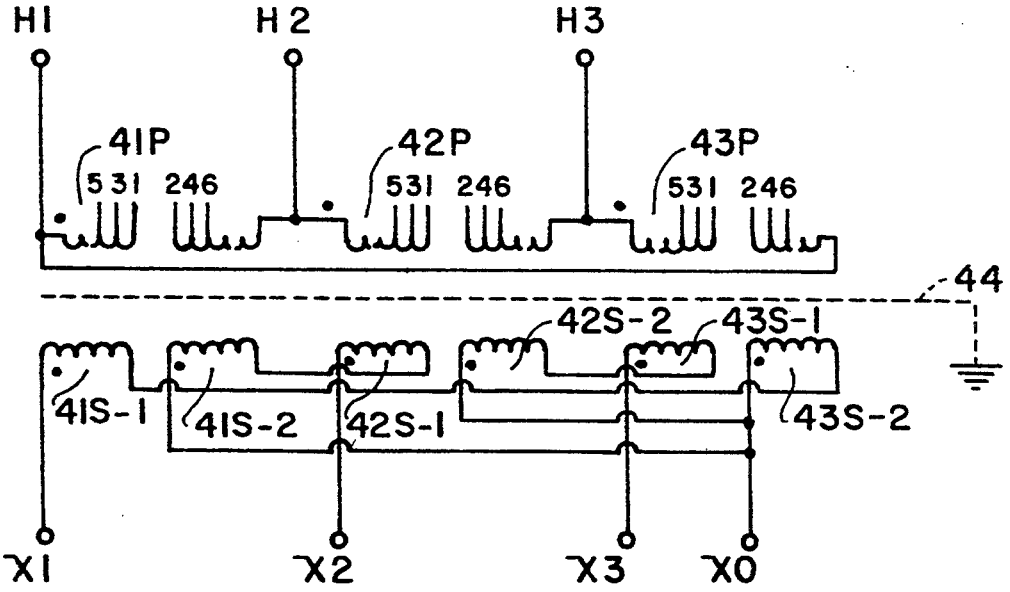
FIG. 4 is a schematic circuit diagram of a transformer winding configuration, in accordance with a first embodiment of the invention.

The power distribution transformer design illustrated in FIG. 4 also includes an electrostatic shield 44 to attenuate common mode harmonics that might arise on either the load side of the transformer or the source bus side of the transformer. These harmonics might arise due to lightning or even due to other power distribution transformers which are connected in the system and which do not adequately attenuate harmonics produced by their load systems. The electrostatic shield can assume various forms such as metal foil used in isolation transformers and is positioned between the primary and secondary windings in each assembly 21, 22 and 23 (FIG. 2 ).

Figure 7:
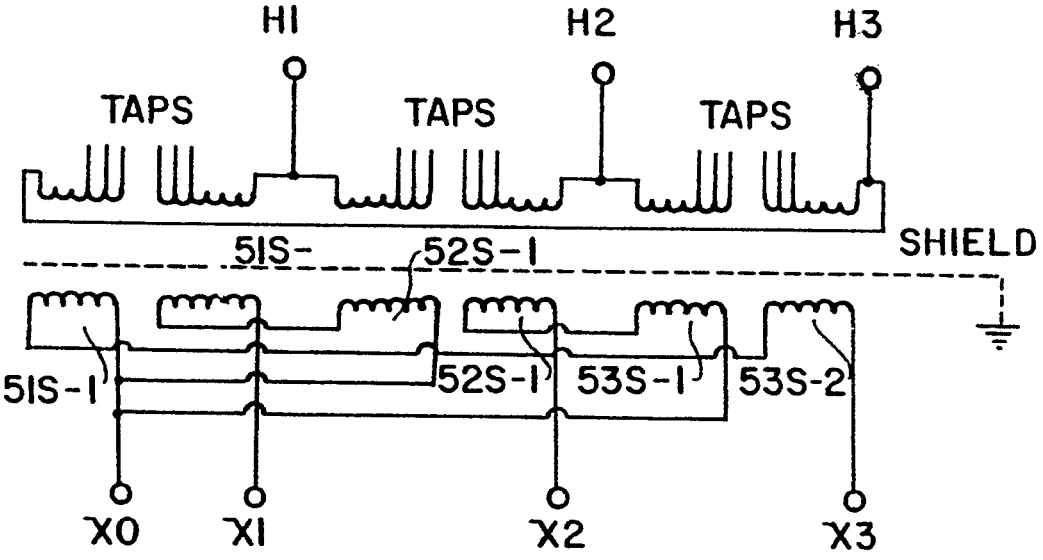
FIG. 7 is a schematic circuit diagram, in part, of a transformer winding configuration and a phasor diagram, in part, in accordance with a second embodiment of the invention.

The zigzag wye configuration can assume some different connections and still operate as described for the FIG. 4 connections. Another possible set of connections for the zigzag wye secondary configuration is shown in FIG. 7 where the X1-X0 phase branch includes windings 51S-2 and 52S-1, the X2-X0 branch windings 52S-2 and 53S-1 and the X3-X0 branch, winding. 53S-2 and 51S-1.

Figure 8:
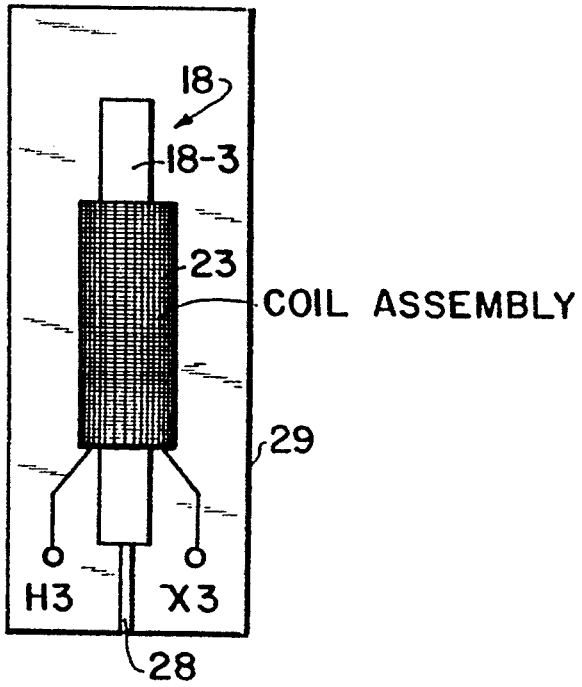
FIG. 8 is a side elevational view of a power distribution transformer in accordance with the present invention.

In accordance with another feature of the invention, the capacitive coupling between the primary and secondary winding is substantially reduced. This is achieved in part by the electrostatic shield 44 (FIG. 4). It is further achieved by means of a ground plane 28 which is positioned between the primary and secondary leads or connections. This is illustrated in FIG. 8 which is a side elevational view of a power distribution transformer embodying the present invention. In this view, winding assembly 23 is mounted on leg 18-3 of magnetic core 18. The primary winding connections H and the secondary connections X are separated from one another by a ground plane 28. This is illustrated in FIG. 8 by primary terminal H3 being to the left side of the ground plane 28 and secondary terminal X3 being to the right hand side of the ground plane 28. The entire transformer can then be mounted within a housing 29 by means not shown, but standard and conventional in the transformer art. The ground plane 28 forms a thin metallic barrier between the two terminals and hence acts to increase the capacitance of each winding to ground while reducing the capacitance between the primary winding and the secondary winding. This ground plane provides a shunt path to ground for the common mode higher frequency harmonics, preventing these harmonics from being capacitively passed from winding to winding or from the load conductors to the supply conductors. The ground plane 28 and the housing 29 may, for example, be constructed of twelve gauge steel.

It is apparent from the above description that the power distribution transformer of the present invention will substantially attenuate triplen harmonic currents and/or voltages from the delta primary winding and from the source power distribution grid. The power distribution transformer does this by employing a secondary zigzag wye winding arrangement in which each phase branch has two coils arranged on different legs of the transformer core such that there is a substantial cancellation of flux in each core leg. In addition, a substantial reduction in capacity coupling between the primary and secondary winding is achieved by means of an electrostatic shield between the two windings and a ground plane which separates the primary winding connections and the secondary winding connections.

Although a particular preferred embodiment of the invention has been disclosed in detail for illustrative purposes, it will be recognized that variations or modifications of the disclosed apparatus lie within the scope of the present invention.

We claim:

1. A three-phase electrical power distribution transformer for translating a three-phase power supply voltage at a supply frequency to a non-linear load system, said transformer having a winding assembly mounted on a magnetic core, the winding assembly having a plurality of primary windings connected in a delta configuration with a plurality of primary leads to receive the supply voltage and a plurality of secondary windings connected in a wye configuration with first, second, and third phase leads and a neutral lead for interconnection with the non-linear load system, said non-linear load system producing triplen harmonic currents in the secondary windings, the improvement comprising:

the secondary windings being connected in a wye configuration, with a bend in each winding, having three phase branches such that magnetic flux produced by said secondary, triplen harmonic, currents is substantially attenuated in the magnetic core, thereby resulting in substantially attenuated triplen harmonic current flow in the delta connected primary winding, there being a phase difference between the currents flowing in each phase branch of said wye configuration such that a voltage magnitude reduction results; and means of compensating for said voltage magnitude reduction due to said phase difference by increasing the turns ratio between the primary and the secondary windings.

2. The invention as defined in claim 1, in which the phase difference is approximately 120°, and the increase in the turns ratio is approximately 15% to 16%.

3. The invention as defined in claim 1, in which the transformer is configured in a housing with a metallic ground plane situated such that all of the transformer primary leads are on one side of the ground plane, and all of the secondary leads are on the other side of said ground plane; and in which an electrostatic shield is positioned between the primary and the secondary windings, whereby the shield and the ground plane substantially reduce the capacitive coupling between the primary and secondary windings.

* * * * *